US010845162B2

(12) United States Patent
Geissele

(10) Patent No.: US 10,845,162 B2
(45) **Date of Patent: *Nov. 24, 2020**

(54) FIREARM ACCESSORY MOUNT

(71) Applicant: WHG Properties, LLC, North Wales, PA (US)

(72) Inventor: William H. Geissele, Lower Gwynedd, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/425,024

(22) Filed: May 29, 2019

(65) Prior Publication Data

US 2019/0277605 A1 Sep. 12, 2019

Related U.S. Application Data

(63) Continuation of application No. 16/123,129, filed on Sep. 6, 2018, now Pat. No. 10,359,258, which is a continuation of application No. 15/474,190, filed on Mar. 30, 2017, now Pat. No. 10,119,787, which is a continuation-in-part of application No. 29/584,526, filed on Nov. 15, 2016, now Pat. No. Des. 822,144.

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 1/387; F41G 1/393; F41C 27/00; F41A 35/00
See application file for complete search history.

(56) References Cited

U.S. PATENT DOCUMENTS

| | | | |
|---|---|---|---|
| D127,735 | S | 6/1941 | Dreyfuss |
| 2,671,287 | A | 3/1954 | Hayes |
| D187,412 | S | 3/1960 | Young |
| 3,091,878 | A | 6/1963 | Savioli |
| 3,269,045 | A | 8/1966 | McGaugher |
| D253,513 | S | 11/1979 | Bertani |

(Continued)

OTHER PUBLICATIONS

TFB Review: Armageddon Tactical AK47 Hinged Side Rail Mount, TheFirearmBlog.com, Posted Aug. 23, 2017 by Miles,[online], [site visited Jan. 8, 2018]. <URL:http://www.thefirearmblog.com/blog/2017/08/23/tfb-review-armageddon-tactical-ak47-hinged-side-rail-mount/> (Year: 2017).

(Continued)

*Primary Examiner* — J. Woodrow Eldred
(74) *Attorney, Agent, or Firm* — Fox Rothschild LLP

(57) ABSTRACT

The disclosure relates to a mount for attaching an accessory to a firearm including: a body having at least one firearm rail mounting feature; at least one mounting cap removably securable to the body, the at least one mounting cap capable of forming a generally cylindrical passage with a portion of the body; and an auxiliary accessory mount removably securable to the body over the at least one mounting cap, wherein the auxiliary accessory mount includes: an accessory mounting surface configured to receive a firearm accessory; and a mounting feature extending generally perpendicular to the accessory mounting surface, the mounting feature being removably securable to the body.

20 Claims, 8 Drawing Sheets

(56) References Cited

U.S. PATENT DOCUMENTS

| | | | |
|---|---|---|---|
| D269,409 | S | 6/1983 | Ferdinand et al. |
| D276,838 | S | 12/1984 | Hill et al. |
| D291,470 | S | 8/1987 | Bechtel |
| 4,709,617 | A | 12/1987 | Anderson |
| D318,313 | S | 7/1991 | Bechtel |
| D318,708 | S | 7/1991 | Bechtel |
| 5,417,002 | A | 5/1995 | Guerra |
| D367,312 | S | 2/1996 | Martel |
| D409,156 | S | 5/1999 | Taylor et al. |
| D410,061 | S | 5/1999 | Emerson |
| 5,941,489 | A | 8/1999 | Fanelli et al. |
| D434,475 | S | 11/2000 | Meda |
| D435,885 | S | 1/2001 | Wallace |
| D462,111 | S | 8/2002 | Turnau, III et al. |
| D463,246 | S | 9/2002 | Becker |
| D464,249 | S | 10/2002 | Laabs et al. |
| D467,789 | S | 12/2002 | Laabs et al. |
| D486,878 | S | 2/2004 | Selvaggio |
| D493,348 | S | 7/2004 | Bertani |
| D508,021 | S | 8/2005 | Wirth |
| D511,365 | S | 11/2005 | Ding |
| D513,056 | S | 12/2005 | Ding |
| D513,298 | S | 12/2005 | Ding |
| D513,299 | S | 12/2005 | Ding |
| D513,633 | S | 1/2006 | Ding |
| D520,949 | S | 5/2006 | Wirth |
| D533,618 | S | 12/2006 | Swan |
| D537,901 | S | 3/2007 | Elkaim |
| D537,902 | S | 3/2007 | Elkaim |
| D539,632 | S | 4/2007 | Ma |
| D542,880 | S | 5/2007 | Cheng |
| D543,605 | S | 5/2007 | Cheng |
| D548,811 | S | 8/2007 | Swan |
| D554,730 | S | 11/2007 | Coggins |
| D555,750 | S | 11/2007 | Cheng |
| D555,751 | S | 11/2007 | Cheng |
| D559,775 | S | 1/2008 | Liukkula et al. |
| D575,619 | S | 8/2008 | Bertani |
| D577,495 | S | 9/2008 | Borovicka et al. |
| 7,481,016 | B2 | 1/2009 | Gonzalez |
| D594,085 | S | 6/2009 | Moody et al. |
| D607,959 | S | 1/2010 | Moody et al. |
| D609,550 | S | 2/2010 | Wan et al. |
| D632,753 | S | 2/2011 | Leighton et al. |
| 7,900,390 | B2 | 3/2011 | Moody et al. |
| D644,085 | S | 8/2011 | Jungen |
| 8,091,265 | B1 | 1/2012 | Teetzel et al. |
| D654,134 | S | 2/2012 | Edge et al. |
| D664,232 | S | 7/2012 | Storch |
| D668,761 | S | 10/2012 | Schad |
| D672,840 | S | 12/2012 | Neufeld |
| D673,239 | S | 12/2012 | Cheng |
| 8,522,469 | B2 | 9/2013 | Baker |
| 8,528,140 | B1 | 9/2013 | Phillips et al. |
| D713,921 | S | 9/2014 | Williams et al. |
| D715,393 | S | 10/2014 | Williams et al. |
| D718,832 | S | 12/2014 | Huang |
| 9,015,982 | B1 | 4/2015 | Powers |
| D732,628 | S | 6/2015 | Cheng et al. |
| D738,986 | S | 9/2015 | Anderson |
| D739,912 | S | 9/2015 | Norberg |
| D741,442 | S | 10/2015 | Wilson |
| D761,929 | S | 7/2016 | Hormann |
| D762,098 | S | 7/2016 | Bertani |
| D762,439 | S | 8/2016 | Bertani |
| D768,257 | S | 10/2016 | Boyd et al. |
| 9,470,480 | B2 | 10/2016 | Kirchhoff |
| D779,623 | S | 2/2017 | Geissele |
| D781,985 | S | 3/2017 | McKillips et al. |
| D781,987 | S | 3/2017 | Geissele |
| D783,112 | S | 4/2017 | Geissele |
| D783,759 | S | 4/2017 | Geissele |
| D784,787 | S | 4/2017 | Bertani |
| D787,007 | S | 5/2017 | Maughn |
| 9,644,913 | B2 | 5/2017 | Dextraze |
| 9,733,034 | B1 | 8/2017 | Viani |
| D798,129 | S | 9/2017 | Bertani |
| D802,077 | S | 11/2017 | Geissele et al. |
| 9,857,146 | B1 | 1/2018 | Shelton et al. |
| D813,639 | S | 3/2018 | Osanai |
| D817,437 | S | 5/2018 | Hancosky |
| 10,119,787 | B2 * | 11/2018 | Geissele ..... F41G 11/003 |
| 2005/0183311 | A1 | 8/2005 | Diaz et al. |
| 2005/0229465 | A1 | 10/2005 | Dextraze |
| 2008/0005952 | A1 | 1/2008 | Sutherby |
| 2009/0038201 | A1 | 2/2009 | Cheng et al. |
| 2010/0071247 | A1 | 3/2010 | Holmberg |
| 2011/0167696 | A1 | 7/2011 | Gangl |
| 2011/0197491 | A1 | 8/2011 | McCann |
| 2012/0311909 | A1 | 12/2012 | Cheng |
| 2013/0008073 | A1 | 1/2013 | Clifton et al. |
| 2013/0185985 | A1 | 7/2013 | Ballard |
| 2013/0312309 | A1 | 11/2013 | Rorick |
| 2014/0259854 | A1 | 9/2014 | Williams et al. |
| 2015/0198397 | A1 | 7/2015 | Motley |
| 2016/0102946 | A1 | 4/2016 | Sharron et al. |
| 2016/0102947 | A1 | 4/2016 | Visinski et al. |
| 2016/0363416 | A1 | 12/2016 | Klotz |
| 2017/0059280 | A1 | 3/2017 | Fravor et al. |

OTHER PUBLICATIONS

SKS See Thru Scout Scope Mount by Brass Stacker, MountPlus.com, [online], [site visited Jan. 8, 2018]. <URL:http://www.mountsplus.com/AR-15_Accessories/AR-15_Scope _Rings/151-TGR-SKS-SSM.html> (Year: 2018).

Trinity Force 30mm Monolithic Quick-Detach Scope Mount w/Top Rail and 1-inch Inserts, Delta Team Tactical.com, [online], [site visited Jan. 8, 2018]. <URL:https://www.deltateamtactical.com/Trinity-Force-30mm-Monolithic-Quick-Detach-Scope-Mount-wTop-Rail-and-1-inch-Inserts_p_4613.html> (Year: 2018).

FAB Defense Glock Tactical Scope Mount, MidwayUSA.com, [online], [site visited Jan. 8, 2018]. <URL:https://www.midwayusa.com/product/1008970315/fab-defense-glock-tactical-scope-mount-all-railed-glock-models> (Year: 2018).

Mini 14 Tactical Metal Quad-rail Handguard, IFAtactical.com, [online], [site visited Jan. 8, 2018], <URL:http://www.fatactical.com/page/19264196> (Year. 2018).

Remington 870 Tactical Mount by Barska, Barska.com, [online], [site visited Jan. 8, 2018]. <URL:https://www.barska.com/remington-870-tactical-mount-rail-by-barska.html> (Year: 2018).

FM Tactical Scope Mount with 1" Rings and Picatinny Rails on Rings, JGsales.com, [online], [site visited Jan. 8, 2018]. <URL:http://www.jgsales.com/fm-tactical-scope-mount-with-1-rings-and-picatinny-rails-on-rings,-black,-fmtm1.-p-3760.html> (Year: 2018).

LaRue Tactical Scope Mount QD LT745, LaRue.com, [online], [site visited Jan. 8, 2018]. <URL:https://www.larue.com/products/larue-tactical-scope-mount-qd-lt7451> (Year 2018).

VTT Knobs with solid section, Elesa-Ganter.com, [online], [site visited May 16, 2018]. <URL:https://www.elesa-ganter.com/products/clamping-knobs/series/vtt> (Year: 2018).

Tekton 26756 10 pc Slotted and Phillips Screwdriver Set, Ebay.com, [online], [site visited May 16, 2018]. <URL:https://www.ebay.com/itm/Tekton-26756-10-Pc-Slotted-and-Phillips-Screwdriver-Set-3-Sided-Handle-USA-Made-/22696470652> (Year: 2018).

Mount three-way Pivot Arm assumbly extension + 2 knob screw bolt nut for Gopro HD, Ebay.com, [online], [site visited May 16, 2018], <URL:https://www.ebay.com/itm/mount-three-way-Pivot-Arm-assembly-extension-2-knob (Year: 2018).

Krofel Magnetic Vehicle Air Vent Mount with Adjustable Knob.com, [online], [site visited May 16, 2018]. <URL:https://www.krofel.com/product/krofel-magnetic-car-air-vent-holded> (Year 2018).

Midwest Industries AK Railed Side Scope Mount Aluminum Black MI-AKSM, CheaperThanDirt.com, [online], [site visited May 16, 2018]. <URL: https://www.cheaperthandirt.com/product/midwest-industries-ak-railed-side-scope-mount-aluminum-black-mi-aksm-816537012030.do> (Year: 2018).

(56) References Cited

OTHER PUBLICATIONS

H&R1871 NEF Pardner Pump Shotgun Scope Base Rail Mount, TrinitySupply.com, [online], [site visited May 16, 2018]. <URL: https://www.trinitysupply.com/H-R-1871-shotgun-saddle-mount-p/295.htm> (Year 2018).

Install Badger Embedded Front Rail (EFR), ShortActionCustoms.com, by admin, Jan. 17,2011, [online], [site visited May 16, 2018]. <URL: http://shortactioncustoms.com/install-badger-embedded-front-frail-efr/> (Year 2011).

* cited by examiner

FIREARM ACCESSORY MOUNT

CROSS-REFERENCE TO RELATED APPLICATION(S)

This application is a continuation of U.S. patent application Ser. No. 16/123,129 filed Sep. 6, 2018, which is a continuation of U.S. patent application Ser. No. 15/474,190 filed Mar. 30, 2017 (now U.S. Pat. No. 10,119,787), which is a continuation-in-part of U.S. Design Patent Application No. 29/584,526 filed Nov. 15, 2016 (now U.S. Pat. No. D822,144), the disclosures of all of which are hereby incorporated by reference in their entireties.

BACKGROUND

Accessories for rifles, such as rangefinders, infrared lasers, and other secondary sighting instruments, are commonly used as auxiliary instruments when a scope is already mounted to the weapon. Traditionally, these accessories are either attached directly to the scope tube or are attached to the scope mount by replacing the scope mount rings or ring caps with a ring or cap having a mountable feature (e.g., Picatinny rail). However, both of these traditional options have significant disadvantages. For instance, when attaching the accessory directly to a scope tube, unnecessary stress is placed on the scope tube, which can damage this delicate piece of equipment. And attaching the accessory to scope mount rings or caps requires the accessory to be cantilevered out over the objective lens of the scope, potentially obscuring the user's view. Also, when the weapon is fired, an accessory attached to scope mount rings or caps is vulnerable to significant vibration (similar to a diving board), which can hinder the accuracy of the accessory and its ability to stay on target. Further, handling the scope mount for the purpose of replacing a scope ring or cap will disrupt the mounting positioning of the scope itself, again potentially reducing the accuracy of the scope and requiring further adjustment. Accordingly, there is a need for an improved mounting system for auxiliary accessories.

SUMMARY

The present disclosure relates generally to a firearm accessory mount. In one possible configuration, and by non-limiting example, the firearm accessory mount includes an auxiliary accessory mounted thereto.

In one aspect, the disclosed technology relates to a mount for attaching an accessory to a firearm including: a body having at least one firearm rail mounting feature; at least one mounting cap removably securable to the body, the at least one mounting cap capable of forming a generally cylindrical passage with a portion of the body; and an auxiliary accessory mount removably securable to the body over the at least one mounting cap, wherein the auxiliary accessory mount includes: an accessory mounting surface configured to receive a firearm accessory; and a mounting feature extending generally perpendicular to the accessory mounting surface, the mounting feature being removably securable to the body. In one embodiment, the mounting feature is positioned generally perpendicular to the cylindrical passage. In another embodiment, the accessory mounting surface is cantilevered away from the body. In another embodiment, the auxiliary accessory mount includes at least one buttress extending from the accessory mounting surface to the mounting feature of the accessory mount. In another embodiment, the auxiliary accessory mount includes a pair of buttresses extending from the accessory mounting surface to the mounting feature of the auxiliary accessory mount. In another embodiment, at least a portion of the accessory mounting surface is a Picatinny rail. In another embodiment, the mounting feature comprises a first mounting feature and the auxiliary accessory mount comprises a second mounting feature removably securable to the body. In another embodiment, the first mounting feature is a pair of first flanges, and the second mounting feature is a pair of second flanges, wherein the first flanges are generally perpendicular to the second flanges. In another embodiment, the mount further includes a second mounting cap removably securable to the body. In another embodiment, the body includes at least one post for receiving the at least one cap, wherein the post includes auxiliary mount mounting features for receiving the mounting feature of the auxiliary accessory mount.

In another aspect, the disclosed technology relates to a mount for attaching an accessory to a firearm that includes: a body having at least one firearm rail mounting feature; at least one mounting cap secured to the body, the at least one mounting cap forming a generally cylindrical passage with a portion of the body; a firearm optic positioned generally within the cylindrical passage; an auxiliary accessory mount secured to the body over the at least one mounting cap, the auxiliary accessory mount including: an accessory mounting surface configured to receive a firearm accessory; and a mounting feature extending generally perpendicular to the accessory mounting surface, the mounting feature being secured to the body. In one embodiment, the mounting feature is positioned generally perpendicular to the cylindrical passage. In another embodiment, the accessory mounting surface is cantilevered away from the body. In another embodiment, the auxiliary accessory mount includes at least one buttress extending from the accessory mounting surface to the mounting feature of the accessory mount. In another embodiment, at least a portion of the accessory mounting surface is a Picatinny rail. In another embodiment, the mounting feature is a first mounting feature, and the auxiliary accessory mount includes a second mounting feature removably secured to the body. In another embodiment, the first mounting feature is a pair of first flanges, and the second mounting feature is a pair of second flanges, wherein the first flanges are generally perpendicular to the second flanges. In another embodiment, the mount further includes a second mounting cap removably secured to the body, wherein the second cap and the at least one cap form the generally cylindrical passage with the body. In another embodiment, the body includes at least one post for receiving the at least one cap, the post including auxiliary mount mounting features for receiving the mounting feature of the auxiliary accessory mount.

In another aspect, the disclosed technology relates to a mount for attaching an accessory to a firearm that includes: a body having at least one firearm rail mounting feature; a first and a second mounting cap removably securable to the body, the first and second mounting caps capable of forming a generally cylindrical passage with a portion of the body; and an auxiliary accessory mount removably securable to the body over at least one of the first and second mounting caps, the auxiliary accessory mount including: an accessory mounting surface configured to receive a firearm accessory; and a first and second set of mounting features being removably securable to the body, at least one of the first and second mounting features extending generally perpendicular to the accessory mounting surface.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Various embodiments of the present disclosure will be described in detail with reference to the drawings, wherein like reference numerals represent like parts and assemblies throughout the several views. Reference to the various embodiments does not limit the scope of the claims attached hereto. Additionally, any examples set forth in this specification are not intended to be limiting and merely set forth some of the many possible embodiments of the appended claims.

DETAILED DESCRIPTION

The firearm accessory mount disclosed herein has several advantages. For example, the firearm accessory mount provides significant versatility because it can be used to mount either a scope alone or both a scope and an auxiliary accessory (e.g., a rangefinder, laser, flashlight, etc.) without having to disturb the positioning of the scope when the auxiliary accessory is attached or detached. Further, the firearm accessory mount can include an auxiliary mount that is attached to a scope mount by way of first and second main body mounting features that are generally perpendicular to one another so as to aid in stability and rigidity of the auxiliary accessory mount. Further, the auxiliary accessory mount includes a pair of buttresses to further aid in rigidity.

As used herein, the word "front" or "forward" corresponds to the direction a projectile (e.g., bullet) will travel, and the word "rear," "rearward," or "back" is the opposite direction toward a firearm stock (if present).

Figure 1:
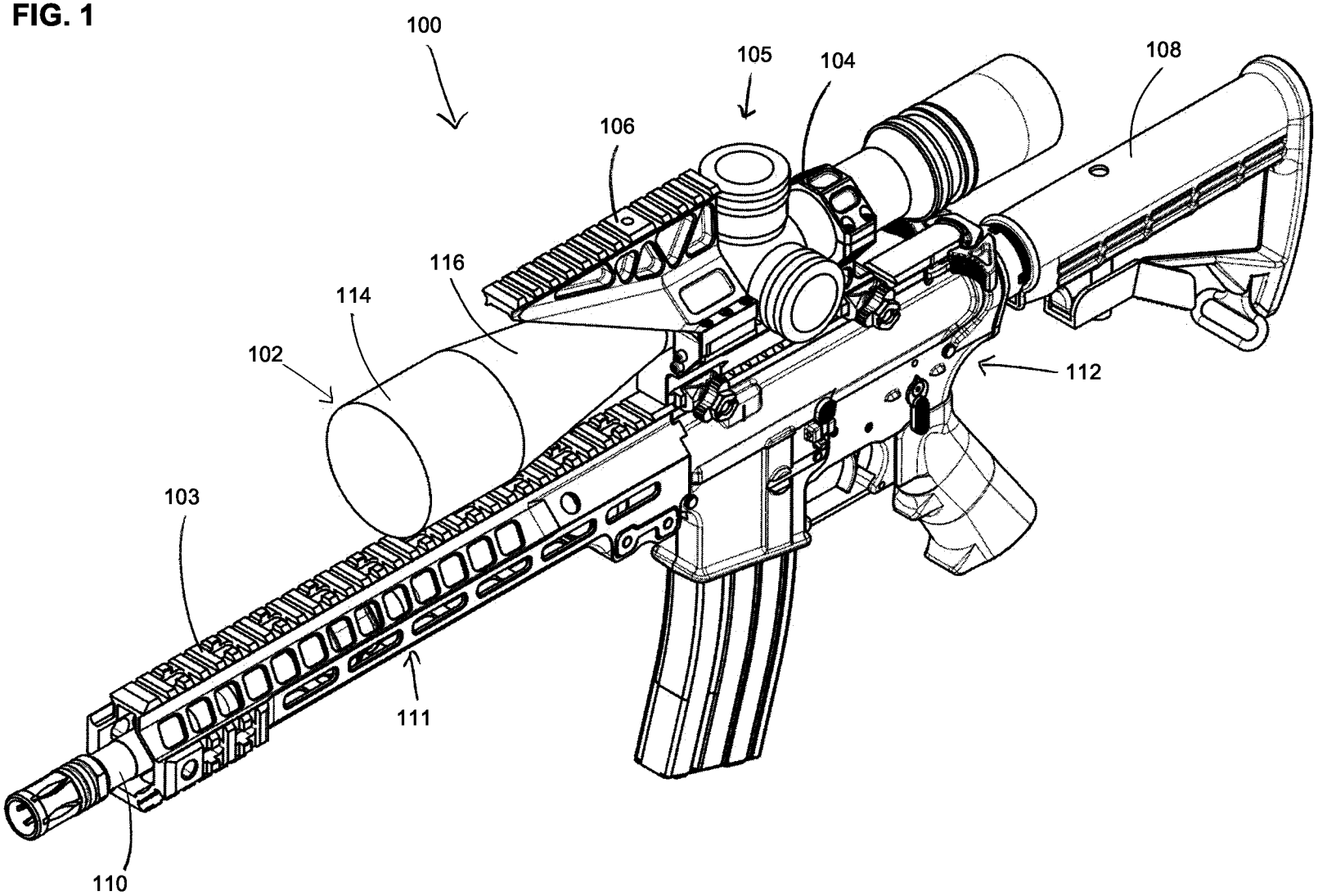
FIG. 1 illustrates a perspective view of a firearm with a firearm accessory mount including a scope mounted thereto, according to one embodiment of the present disclosure.
Figure 2:
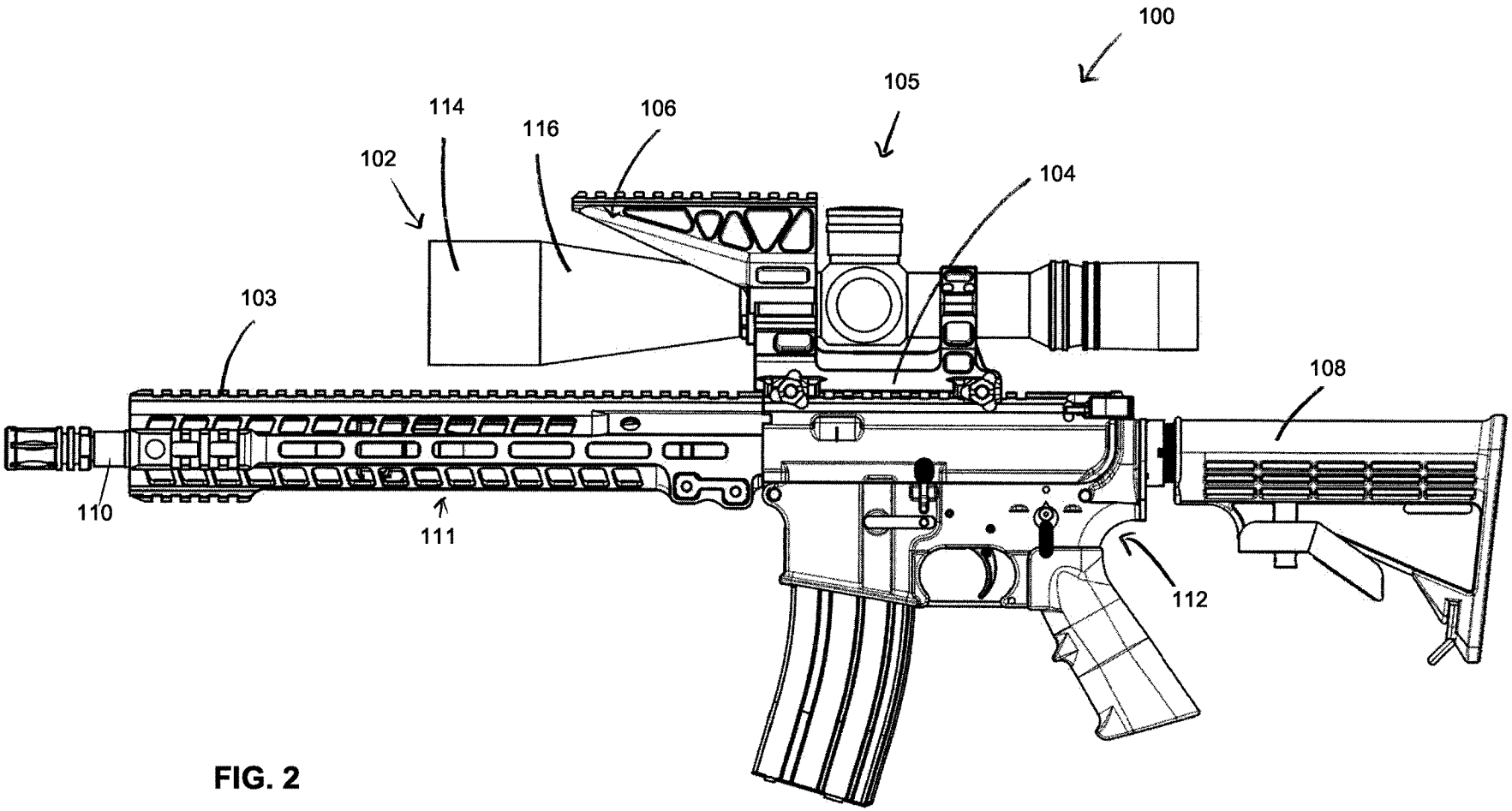
FIG. 2 illustrates a side view of the firearm with the firearm accessory mount of FIG. 1.

FIG. 1 shows a perspective view of an embodiment of a firearm 100. In this embodiment, the firearm 100 includes a scope 102 mounted to a mounting rail 103 of the firearm 100 by a firearm accessory mount 105. The depicted embodiment of the firearm accessory mount 105 includes a scope mount 104 and an auxiliary accessory mount 106 mounted thereto.

In some embodiments, the firearm 100 may also include a stock 108, a barrel 110, and a receiver 112. The firearm 100 can be of a variety of types. Examples of a firearm include handguns, rifles, shotguns, carbines, and personal defense weapons. In at least one embodiment, the firearm is an AR-15 rifle or a variant of the AR-15.

The receiver 112 is configured to house a firing mechanism and associated components as found in, for example, rifles. The stock 108 is configured to be positioned at a rearward portion of the firearm 100. The stock 108 provides an additional surface for a shooter to support the firearm 100, such as against the shooter's shoulder. In some embodiments, the stock 108 is mounted to the receiver 112. The barrel 110 is positioned at a forward end of the firearm 100 and is configured to be installed on the receiver 112. The barrel 110 provides a path to release an explosion gas and propel a projectile therethrough. The firearm 100 also, in some examples, includes a handguard 111 that surrounds the barrel 110 and is attached to the receiver 112.

The depicted scope 102 can be any scope that is used in conjunction with a firearm. The scope 102 has an objective lens 114 positioned in the forward direction and extending above the barrel 110, handguard 111, and receiver 112. The objective lens 114 can have a cylindrical shape with a defined diameter. The scope 102 can also include an objective bell 116 that has a cone-like shape and transitions to the objective lens 114.

In the depicted example, the mounting rail 103 extends from the handguard 111 to the receiver 112. In some examples, the mounting rail 103 is disposed only on either the handguard 111 or the receiver 112. The mounting rail 103 is configured to receive mounting accessories (e.g., a foregrip, a flashlight, a laser, optic equipment, etc.) thereto, such as the firearm accessory mount 105. The mounting rail 103 can be a Picatinny rail, a Weaver rail, or another suitable type of rail. In other examples, the mounting rail 103 can be a pair of lugs.

Figure 3:
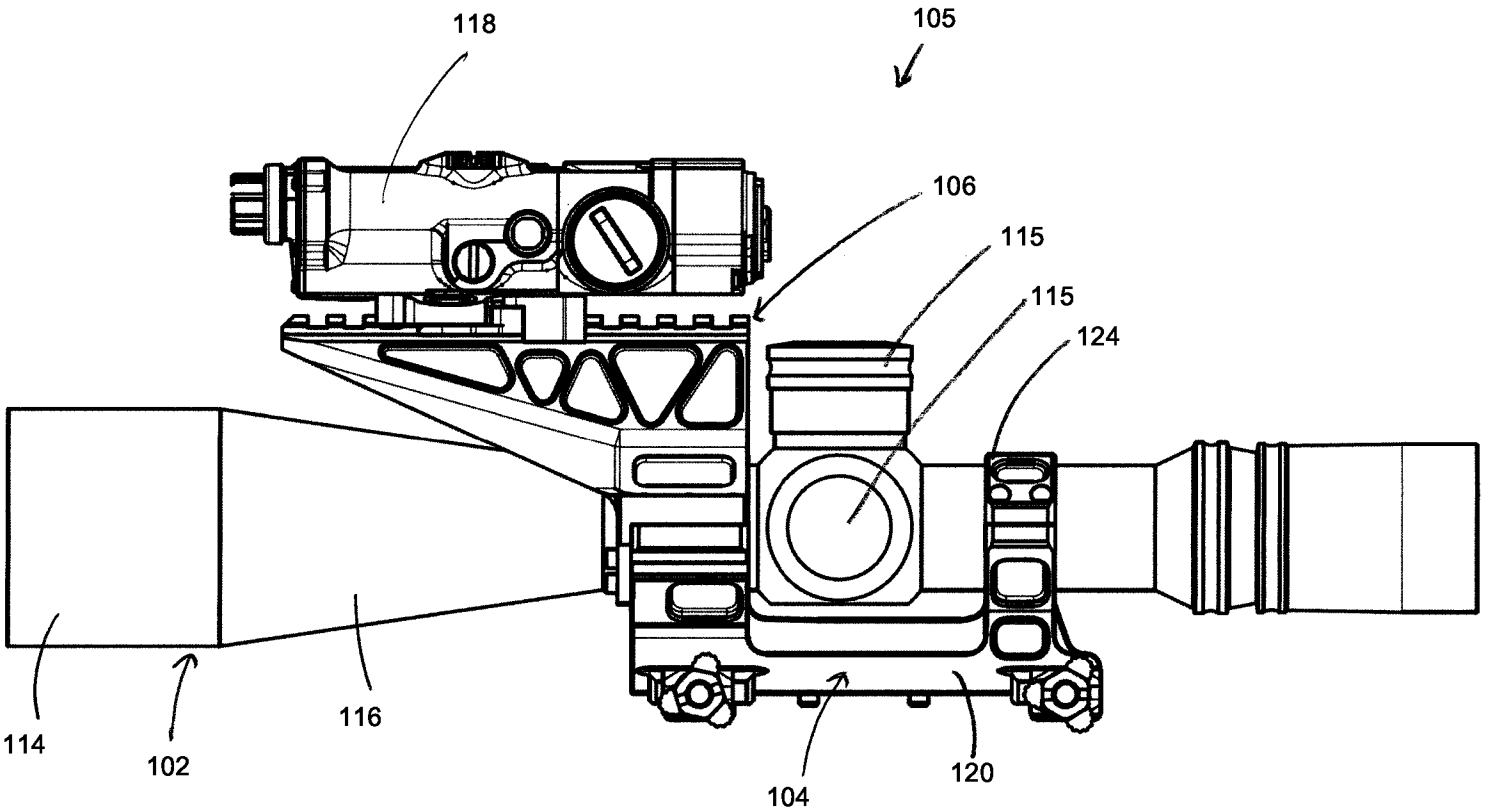
FIG. 3 illustrates a side view of the firearm accessory mount of FIG. 1 further including a rangefinder device mounted thereto.

The scope mount 104 is configured to mount the scope 102 to the firearm 100, as noted above. The auxiliary accessory mount 106 provides a location to mount additional accessories without interfering with the operation of particular features of the scope (e.g., adjustment knobs 115). In the example shown in FIG. 3, a rangefinder device 118 is mounted to the auxiliary accessory mount 106. The auxiliary accessory mount 106 is configured to be positioned above the scope 102, specifically above the objective bell 116. This provides a preferable mounting location for an auxiliary accessory, such as rangefinder 118, as it is positioned generally along the same sight line as scope 102 when the firearm 100 is being operated by a user. This allows the user to quickly switch between looking through the scope 102 and monitoring or operating the accessory mounted to the auxiliary accessory mount 106.

Figure 4:
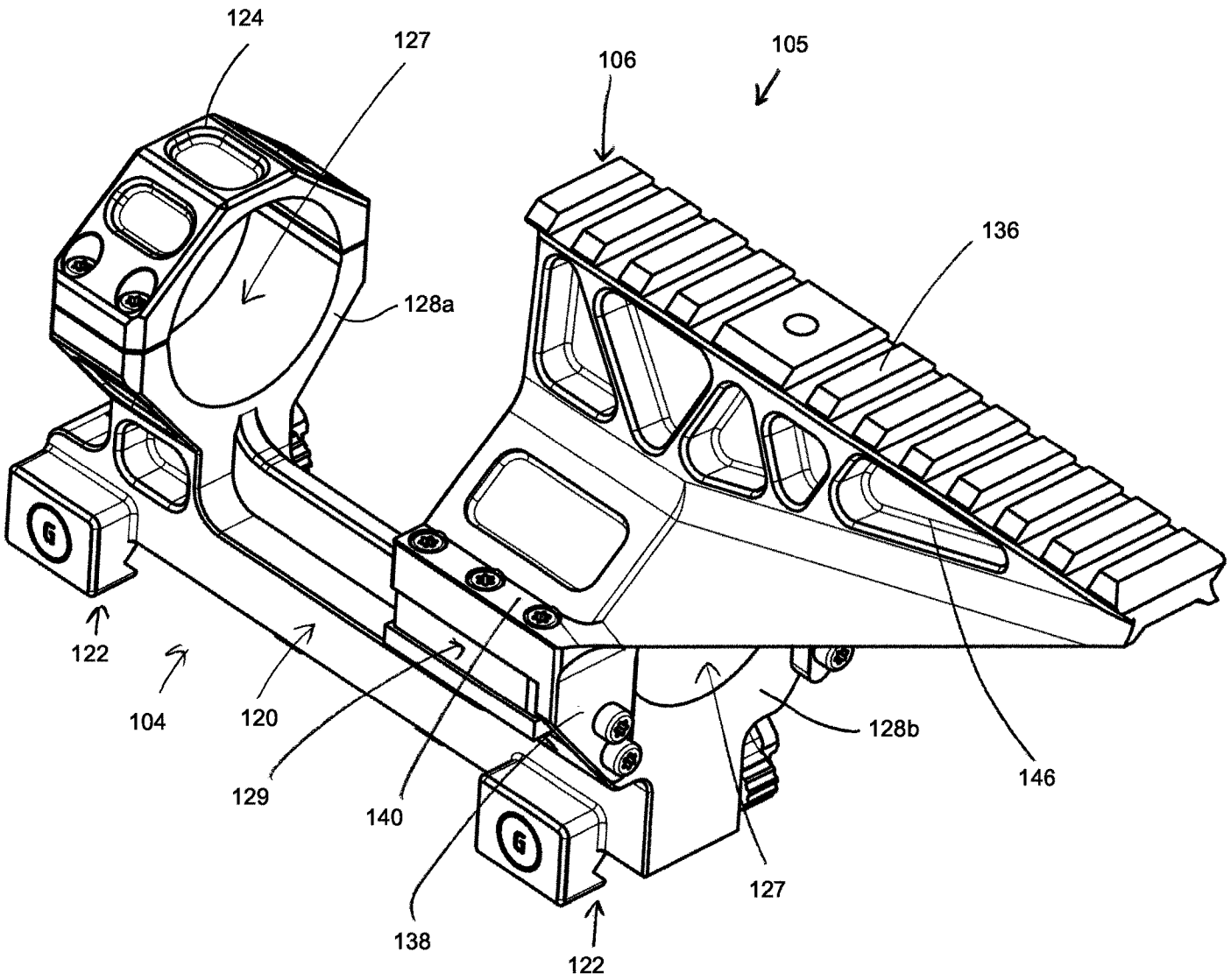
FIG. 4 illustrates a perspective view of the firearm accessory mount of FIG. 1.
Figure 5:
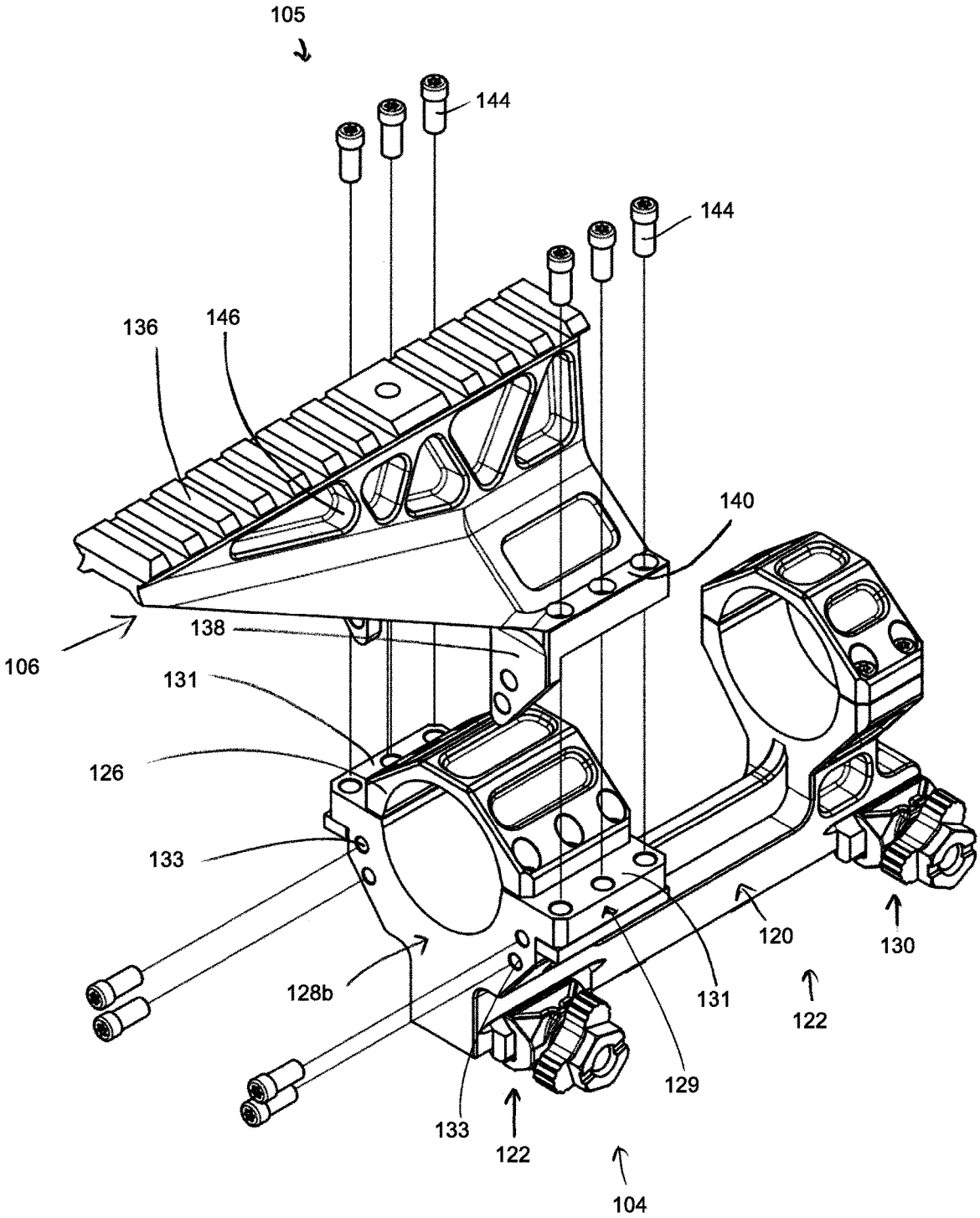
FIG. 5 illustrates a partially exploded view of the firearm accessory mount of FIG. 1.
Figure 6:
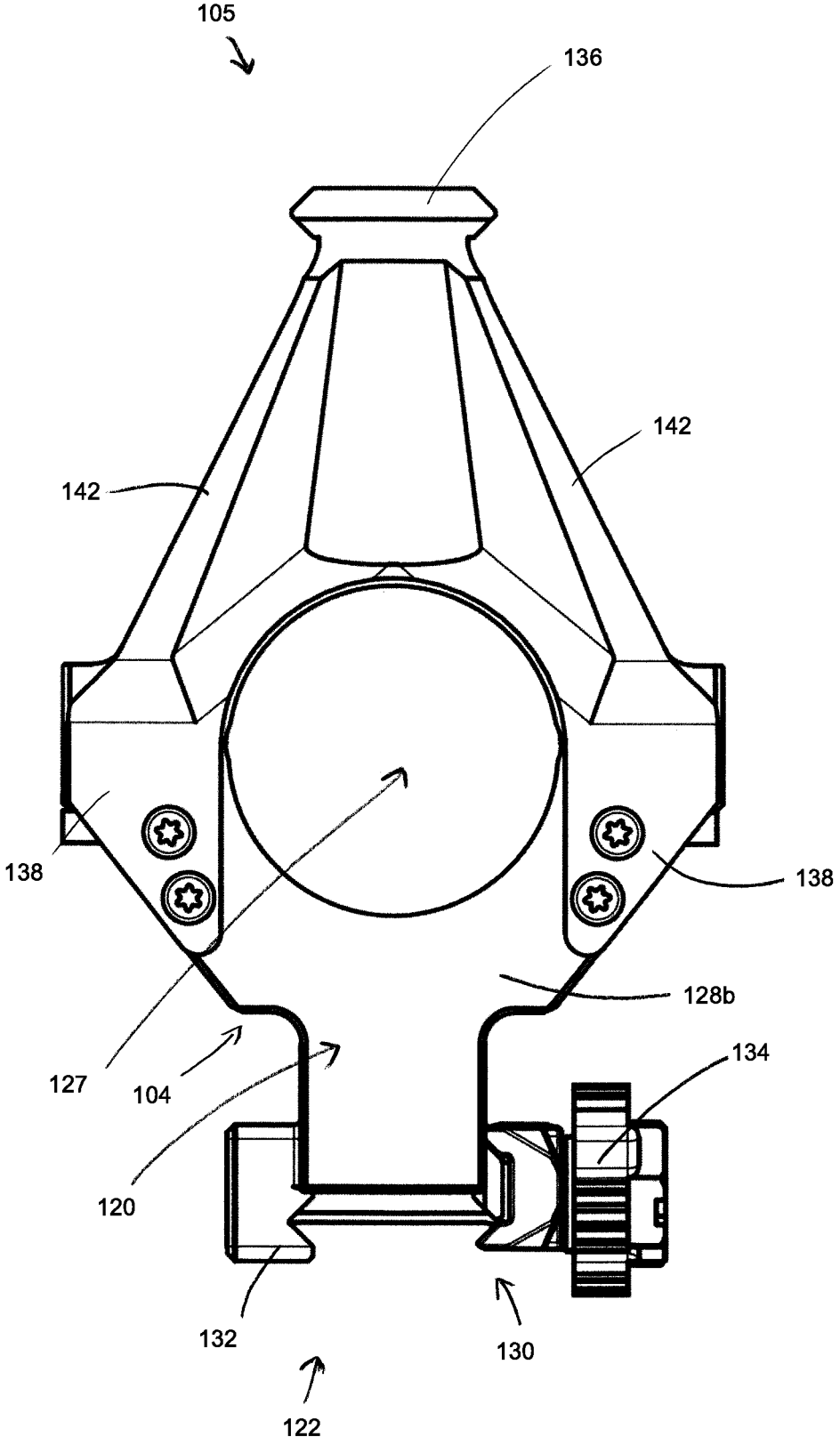
FIG. 6 illustrates a front view of the firearm accessory mount of FIG. 1.
Figure 7:
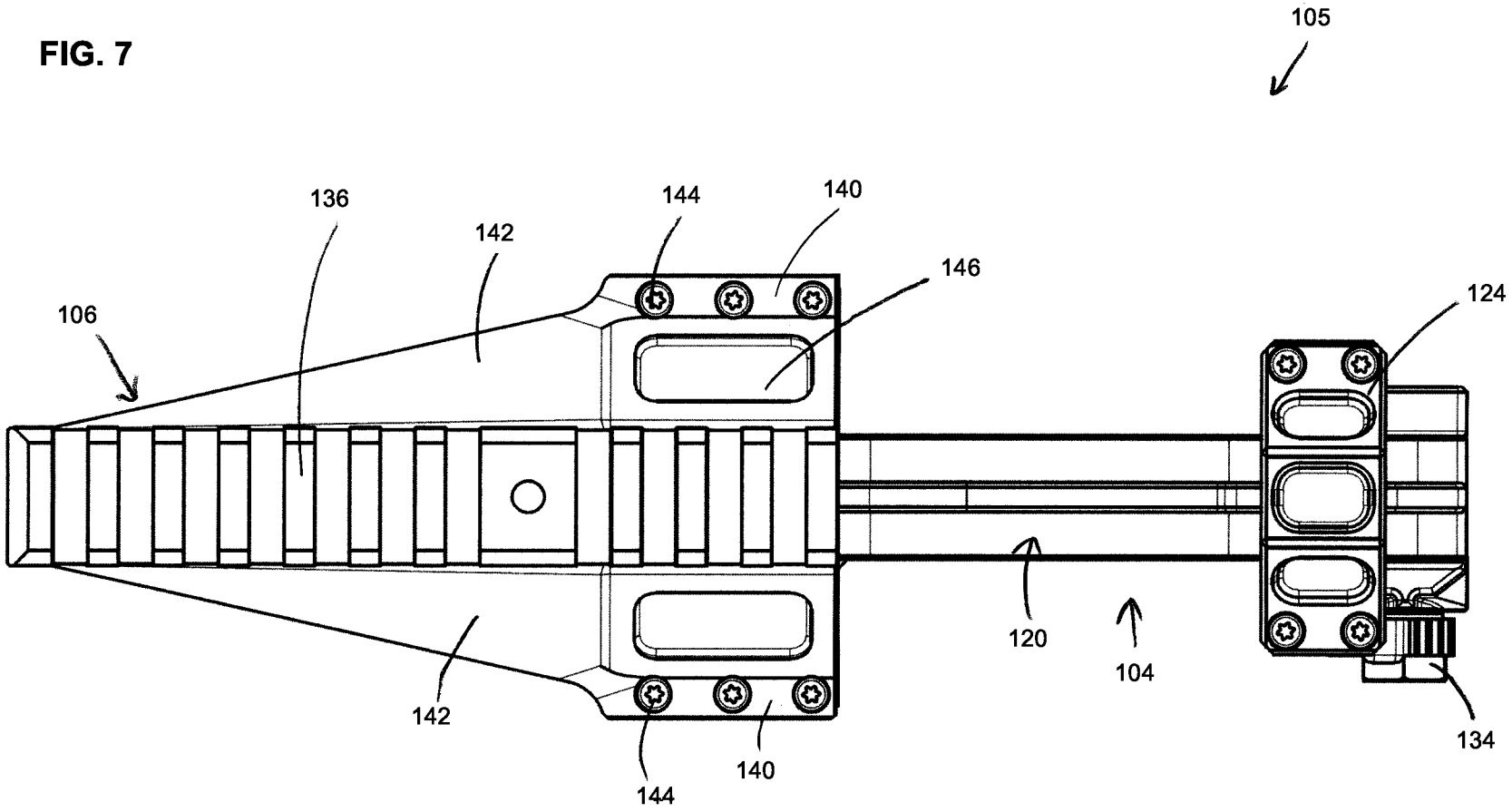
FIG. 7 illustrates a top view of the firearm accessory mount of FIG. 1.
Figure 8:
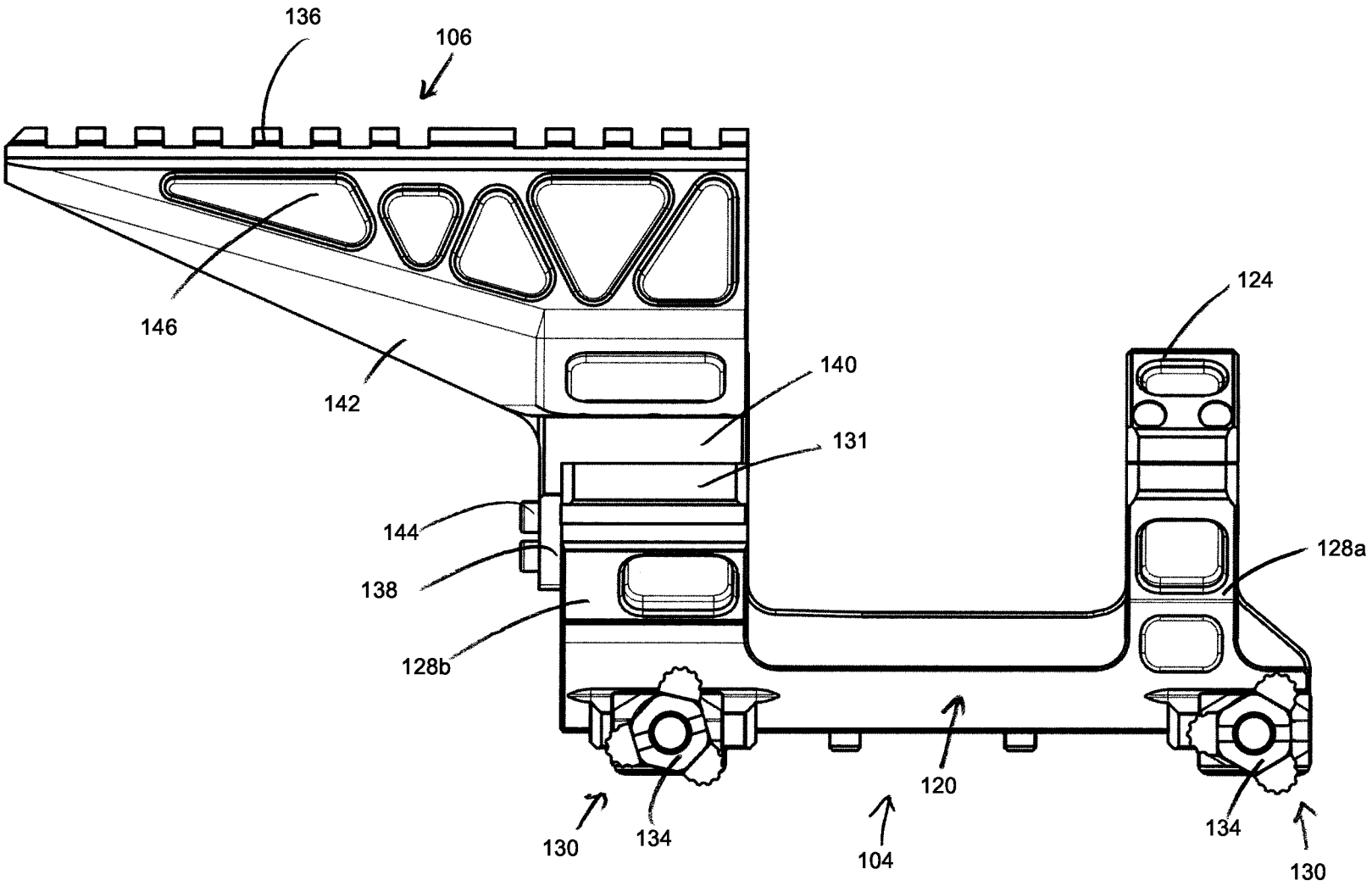
FIG. 8 illustrates a side view of the firearm accessory mount of FIG. 1.

FIG. 4 shows a perspective view of the firearm accessory mount 105. FIG. 5 shows a perspective view of the auxiliary accessory mount 106 removed from the scope mount 104. FIG. 6 shows a front view of the firearm accessory mount 105. FIG. 7 shows a top view of the firearm accessory mount 105. FIG. 8 shows a side view of the firearm accessory mount 105.

The scope mount 104 includes a main body 120, a firearm mounting feature 122 secured to the main body 120, a first and a second mounting cap 124, 126 removably secured to the main body 120, and the auxiliary accessory mount 106 removably securable to main body 120 over the second mounting cap 126.

The main body 120 is securable to the firearm 100 by way of the firearm mounting feature 122. Further, the main body 120 includes a pair of mounting posts 128*a*, 128*b* that are configured to receive the first and second mounting caps 124, 126 respectively. In some examples, the posts 128*a*, 128*b* are identical. In other examples, the posts differ in design. Together with mounting caps 124, 126, the posts 128*a*, 128*b* form a generally cylindrical passage 127 so as to receive a scope for mounting. In other examples, the caps 124, 126, along with the posts 128*a*, 128*b*, form other, differently shaped passages, depending on the scope shape that the scope mount 104 is configured to receive.

The main body 120 also includes an auxiliary mount mounting feature 129. The auxiliary mount mounting feature 129 is configured to receive and secure the auxiliary accessory mount 106 to the main body 120. In the depicted example, the auxiliary mount mounting feature 129 is a pair of flanges 131 arranged on the post 128*b* and a plurality of apertures 133 disposed within the post 128*b*. In some examples, both posts 128*a*, 128*b* may include an auxiliary mount mounting feature 129.

The firearm mounting feature 122 is configured to fix an accessory to the mounting rail 103 of the firearm 100. In some examples, the firearm mounting feature 122 includes a pair of fastener blocks 130, which can also be called clamp blocks, fastener brackets, or clamp brackets. The fastener blocks 130 are secured to the main body 120, for example through unitary monolithic construction. Alternatively, the firearm mounting feature 122 can secure to the mounting rail 103 through other methods and fasteners for securing that are understood by those of ordinary skill in the art—e.g., a quick detach lever.

As shown in the front view of the firearm accessory mount 105 in FIG. 6, the fastener blocks 130 each include a stabilizer block 132 and a fastener 134. The stabilizer block 132 stabilizes the fastener block 130 to the mounting rail 103 (FIG. 1), and the fastener 134 secures the fastener block 130 to the mounting rail 103. The stabilizer block 132 fits around and over the mounting rail 103. The fastener 134 can include a threaded screw or pair of threaded screws that can be twisted to tighten the fastener block 130 against the mounting rail 103 (FIG. 1). The fastener 134 is connected to the stabilizer block 132 so that, when tightened, the fastener 134 pulls the stabilizer block toward the fastener 134 and clamps the fastener block 130 onto the mounting rail 103 (FIG. 1). In use, the firearm accessory mount 105 can be secured to the mounting rail 103 (FIG. 1) such that the fastener 134 is positioned along the right or left side of the firearm 100 (FIG. 1).

The caps 124, 126 are configured to help secure the scope 102 to the scope mount 104. The caps 124, 126 are fixed by way of fasteners to the posts 128*a*, 128*b* of the main body 120 to secure the scope 102 to the main body 120. The second cap 126 is configured so that the auxiliary accessory mount 106 can be mounted over the top of the second cap 126. This allows a user to secure the scope 102 to the scope mount 104 via the caps 124, 126 and align the scope to the desired sighting preference. The auxiliary accessory mount 106 can then be attached over the second cap 126 to the main body 120 via the auxiliary mount mounting feature 129, and can easily be removed at any time without disrupting the mounting of the scope 102 within the scope mount 104.

The auxiliary accessory mount 106 is removably connected to the main body 120 of the scope mount 104. In one embodiment, the auxiliary accessory mount 106 is cantilevered away from the main body 120, generally parallel to the cylindrical passage 127. In one embodiment, the auxiliary accessory mount 106 includes an accessory mounting surface 136, a first pair of main body mounting features 138, a second pair of main body mounting features 140, and a pair of buttresses 142 extending from the accessory mounting surface 136.

The accessory mounting surface 136 can be a rail. The accessory mounting surface 136 is positioned atop the auxiliary accessory mount 106, and at the opposite side of the scope mount 104 from the fastener block 130. The accessory mounting surface 136 is adapted to support and secure an auxiliary accessory. The accessory mounting surface 136 can be a Picatinny, Weaver, or other type rail. Alternatively, the accessory mounting surface 136 can receive an auxiliary accessory through other methods understood by those of ordinary skill in the art—e.g., fasteners such as screws, clamps, quick detach levers, guide insert channels, and/or snaps.

The first pair of main body mounting features 138 is configured to aid in securing the auxiliary accessory mount 106 to the main body 120. In the depicted example, the first pair of main body mounting features 138 is a pair of flanges arranged generally perpendicular to the second pair of main body mounting features 140. In some examples, the first pair of main body mounting features 138 are arranged generally perpendicular to the cylindrical passage 127 and to the accessory mounting surface 136. The first pair of main body mounting features 138 may be configured to mate with apertures 133 in the post 128*b* of the main body 120.

The second pair of main body mounting features 140 are configured to aid in securing the auxiliary accessory mount 106 to the main body 120. In the depicted example, the second pair of main body mounting features 140 is a pair of flanges configured to mate with flanges 131 on the post 128*b* of the main body 120. In some examples, the second pair of main body mounting features 140 are configured to be secured to the flanges 131 via fasteners 144.

By providing first and second main body mounting features 138, 140, the auxiliary accessory mount 106 is mounted to main body 120 so as to resist movement. By positioning the first and second main body mounting features 138, 140 generally perpendicular to one another, the first and second main body mounting features 138, 140 aid in reducing bouncing movement or excessive vibration caused by the discharging of the firearm 100. For instance, this advantageous result can be achieved by positioning the first main body mounting features 138 generally perpendicular to the accessory mounting surface 136. In some examples, the auxiliary accessory mount 106 includes a single first main body mounting feature 138. In other examples, the auxiliary accessory mount 106 includes more than two first main body mounting features 138. In some examples, the auxiliary accessory mount 106 includes a single second main body mounting feature 140. In other examples, the auxiliary accessory mount 106 includes more than two second main body mounting features 140. In other examples, the auxiliary accessory mount 106 includes only first main body mounting features 138.

The pair of buttresses 142 extends from the accessory mounting surface 136 to the first and second main body mounting features 138, 140. The buttresses 142 support the accessory mounting surface 136 along its entire length, thereby strengthening the accessory mounting surface 136 and increasing its resistance to vibration and movement. In some examples, the buttresses support the accessory mounting surface 136 along the majority of its length. Further, as shown in FIG. 6, the buttresses 142 are positioned so as to surround the objective bell 116 of the scope 102. This prevents potential interference with or damage to the scope 102 after or as the auxiliary accessory mount 106 is mounted to the scope mount 104.

The auxiliary accessory mount 106 along with the scope mount 104, in general, can also include a plurality of apertures 146 to help reduce the overall weight of the firearm accessory mount 105.

To install the firearm accessory mount 105 to the firearm 100, the firearm mounting feature 122 (e.g., fastener blocks 130) is secured to the mounting rail 103. The scope 102 can then be positioned within the cylindrical passage 127 and adjusted accordingly before securing the first and second caps 124, 126 to the main body 120 of the scope mount 104. The user may then use the scope mount 104 without installing the auxiliary accessory mount 106. When and if the user decides to utilize the auxiliary accessory mount 106, the user can attach the auxiliary accessory mount 106 atop the second cap 126, and can secure both the first pair of main body mounting features 138 to the apertures 133 of the main body 120 and the second pair of main body mounting features 140 to the flange 131 of the post 128*b* of the main body 120.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

I claim:

1. A mount for attaching an accessory to a firearm, comprising:

a body comprising a lower surface that faces the firearm when the body is mounted on the firearm; a front surface; and an upper surface;

at least one mounting cap removably securable to the upper surface of the body, the at least one mounting cap capable of forming a generally cylindrical passage within a portion of the body; and an auxiliary accessory mount removably securable to the body over the at least one mounting cap, the auxiliary accessory mount comprising:

an accessory mounting surface configured to receive a firearm accessory;

a first mounting feature comprising a first flange being removably securable to the front surface of the body; and a second mounting feature comprising a second flange being removably securable to the upper surface of the body.

2. The mount of claim 1, wherein the first flange extends generally perpendicular to the second flange.

3. The mount of claim 1, wherein the body further comprises at least one firearm rail mounting feature.

4. The mount of claim 1, wherein the first flange extends generally perpendicular to the accessory mounting surface.

5. The mount of claim 4, wherein the second flange extends generally parallel to the accessory mounting surface.

6. The mount of claim 1, wherein the upper surface of the body is generally perpendicular to the front surface of the body.

7. The mount of claim 1, wherein the first flange is positioned generally perpendicular to the cylindrical passage.

8. The mount of claim 1, wherein the accessory mounting surface is cantilevered away from the body.

9. The mount of claim 1, wherein the auxiliary accessory mount further comprises at least one buttress extending from the accessory mounting surface to at least one of the first and second mounting features of the accessory mount.

10. The mount of claim 1, wherein at least a portion of the accessory mounting surface is a Picatinny rail.

11. The mount of claim 1, further comprising a second mounting cap removably securable to the body; wherein the second mounting cap and the at least one mounting cap form the generally cylindrical passage within the body.

12. The mount of claim 1, wherein the body further comprises at least one post for receiving the at least one mounting cap, the post including auxiliary mount mounting features for receiving at least one of the first and second mounting features of the auxiliary accessory mount.

13. The mount of claim 1, wherein:

the first mounting feature further comprises a third flange, the third flange being removably securable to the front surface of the body; and the second mounting feature further comprises a fourth flange, the fourth flange being removably securable to the upper surface of the body.

14. The mount of claim 13, wherein the auxiliary accessory mount further comprises a pair of buttresses extending from the accessory mounting surface to at least one of the first and second mounting features.

15. The mount of claim 12, wherein the auxiliary mount mounting features in the post comprise apertures; and the first mounting feature of the auxiliary accessory mount is configured to mate with the apertures.

16. The mount of claim 15, wherein the auxiliary mount mounting features in the post further comprise a flange; and the second mounting feature of the auxiliary accessory mount is configured to mate with the flange of the auxiliary mount mounting features.

17. The mount of claim 9, wherein the least one buttress supports the accessory mounting surface along at least a majority of a length of the accessory mounting surface.

18. The mount of claim 1, wherein the auxiliary accessory mount is mounted over a top of the at least one mounting cap.

19. The mount of claim 18, wherein the auxiliary accessory mount is configured to be attached over the at least one mounting cap to the main body via the first and second mounting features of the auxiliary accessory mount.

20. A firearm comprising the mount of claim 1.

* * * * *